US006817324B2

(12) United States Patent
Asano et al.

(10) Patent No.: US 6,817,324 B2
(45) Date of Patent: Nov. 16, 2004

(54) CONTROL UNIT OF ELECTROMAGNETICALLY DRIVEN VALVE AND CONTROL METHOD THEREOF

(75) Inventors: Masahiko Asano, Toyota (JP); Takashi Izuo, Toyota (JP); Kiyoharu Nakamura, Seto (JP); Takeshi Sakuragi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/341,469

(22) Filed: Jan. 14, 2003

(65) Prior Publication Data

US 2003/0136362 A1 Jul. 24, 2003

(30) Foreign Application Priority Data

Jan. 23, 2002 (JP) ..... 2002-014404

(51) Int. Cl.[7] ..... F01L 9/04
(52) U.S. Cl. ..... 123/90.11; 251/129.1
(58) Field of Search ..... 123/90.11; 251/129.1; 137/906

(56) References Cited

U.S. PATENT DOCUMENTS 5,611,303 A 3/1997 Izuo
5,988,124 A * 11/1999 Duesmann ..... 123/90.11
6,076,490 A 6/2000 Esch et al.
6,326,873 B1 * 12/2001 Faria ..... 335/251
6,415,751 B2 * 7/2002 Meissner et al. ..... 123/90.11

FOREIGN PATENT DOCUMENTS

| | | |
|---|---|---|
| FR | 2 806 146 A | 9/2001 |
| JP | 8-189315 A | 7/1996 |
| JP | 11-93630 | 6/1999 |
| JP | 2000-27616 A | 1/2000 |
| JP | 2000-34912 A | 2/2000 |

* cited by examiner

*Primary Examiner*—Thomas Denion
*Assistant Examiner*—Zelalem Eshete
(74) *Attorney, Agent, or Firm*—Kenyon & Kenyon

(57) ABSTRACT

A control unit controls an electromagnetically driven valve including a valve body, an electromagnetic drive portion and a spring so as to be opened and closed by an electromagnetic force of the electromagnetic drive portion and a spring force of the spring that is formed of a pair of gas pressure springs each urging the valve body towards a valve opening end position and a valve closing end position, respectively. The control unit includes a controller, when an operation of the valve body is stopped and held in a holding position that is one of the valve opening end position and the valve closing end position, decreases a gas pressure of one of the pair of gas pressure springs that urges the valve body towards a non-holding position opposite to the holding position so as to become lower than a gas pressure of the one of the pair of gas pressure springs that urges the valve body towards the non-holding position when the valve body is operated.

8 Claims, 5 Drawing Sheets

FULLY-OPENED POSITION

NEUTRAL POSITION

FULLY-CLOSED POSITION $P0 < P1 < Pn < P2$

CONTROL UNIT OF ELECTROMAGNETICALLY DRIVEN VALVE AND CONTROL METHOD THEREOF

INCORPORATION BY REFERENCE

This disclosure of Japanese Patent Application No. 2002-014404 filed on Jan. 23, 2002 including the specification, drawings and abstract is incorporated herein by reference in the entirety.

BACKGROUND OF THE INVENTION

1. Field of Invention

The invention relates to a control unit of an electromagnetically driven valve and a control method of the electromagnetically driven valve.

2. Description of Related Art

There is known a control unit of an electromagnetically driven valve for controlling opening and closing of a valve body of the electromagnetically driven valve serving as an intake valve or an exhaust valve of an internal combustion engine in response to energization and de-energization of an electromagnet. Generally the electromagnetically driven valve includes an electromagnet that generates electromagnetic force for attracting an armature which reciprocates together with the valve body, and a pair of springs for urging the valve body towards opposite ends of the valve-closing side and valve-opening side, that is, the fully-closed position and fully-opened position of the valve body, respectively. The respective spring forces of the pair of springs are set so as to be balanced with each other when the valve body is located in "a neutral position" as a substantially middle position between the valve closing end and the valve opening end.

Japanese Laid-Open Patent Publication No. 2000-34912 discloses another type of the electromagnetically driven valve, which includes an air pressure spring in place of the ordinary spring as indicated above. The air pressure spring of the electromagnetically driven valve includes a cylinder, a piston disposed within the cylinder, and a pressure chamber defined by the cylinder and the piston. The air pressure spring is adapted to urge, via the piston, the valve body using the pressure of compressed air stored in the pressure chamber.

In the aforementioned internal combustion engine (hereinafter simply referred to as an "engine" where appropriate) including a control system that controls such electromagnetically operated valves serving as intake and exhaust valves, the number of open/close operations of one or more of the electronically valves may be reduced during a low load operation of the engine. In this case, the valve body of the intake valve or the exhaust valve, which is to be stopped may be held in a fully-opened position or a fully-closed position. The valve body is urged by a spring force of the spring so as to be returned to the neutral position. Therefore, the valve body is held in the fully-opened or the fully-closed position against the spring force of the spring in the stopped state of the open and close operation of the valve using the electromagnetic force generated by applying holding current to the electromagnet. Accordingly, this may hinder reduction in power consumption of the control unit of the electromagnetically driven valve.

SUMMARY OF THE INVENTION

It is therefore an object of the invention to provide a control unit of an electromagnetically driven valve, which save energy for holding the valve body of the electromagnetically driven valve in the fully-opened or fully-closed position in the stopped state of the open and close operation of the electromagnetically driven valve.

Hereinafter, the structure of the control unit of the electromagnetically driven valve of the invention, effects and advantages thereof will be described hereinafter.

In an embodiment of the invention, a control unit of an electromagnetically driven valve is provided. The electromagnetically driven valve includes a valve body, an electromagnetic drive portion and a spring so as to be opened and closed by an electromagnetic force of the electromagnetic drive portion and a spring force of the spring that is formed of a pair of gas pressure springs each urging the valve body towards a valve opening end position and a valve closing end position, respectively. The control unit includes a controller, when an operation of the valve body is stopped and held in a holding position that is one of the valve opening end position and the valve closing end position, decreases a gas pressure of one of the pair of gas pressure springs that urges the valve body towards a non-holding position opposite to the holding position so as to become lower than a gas pressure of the one of the pair of gas pressure springs that urges the valve body towards the non-holding position when the valve body is operated.

According to the embodiment of the invention, when the valve body is held in a holding position as one of the fully-opened and the fully-closed position in the stopped state of the open and close operation of the valve, the gas pressure of the spring that urges the valve body towards the non-holding position as the other one of the fully-opened and the fully-closed position is decreased to be lower than the gas pressure of the spring during the open and close operation of the valve. More specifically, when the valve body is held in the fully-opened position, the gas pressure of the gas spring that urges the valve body towards the fully-closed position is decreased. Meanwhile, when the valve body is held in the fully-closed position, the gas pressure of the gas spring that urges the valve body towards the fully-opened position is decreased.

Accordingly, the spring force that moves the valve body away from the holding position may be reduced. This makes it possible to reduce the electromagnetic force of the electromagnet required for holding the valve body in the holding position, thus reducing the holding current.

When the gas pressure of the gas spring that urges the valve body towards the non-holding position is reduced to be lower than a predetermined value, a resultant force of the springs may be directed towards the holding position. This makes it possible to hold the valve body in position without applying the holding current to the electromagnet.

The aforementioned structure may allow reduction of energy required for holding the valve body in the holding position that is either the fully-opened position or the fully-closed position in a stopped state of open and close operation of the electromagnetically driven valve.

In the embodiment, the controller controls a gas pressure of a pressure chamber of one of the pair of gas pressure springs such that a spring force of the one of the pair of gas pressure springs that urges the valve body towards the non-holding position becomes smaller than a spring force of the other gas pressure spring that urges the valve body towards the holding position when the operation of the valve body is stopped and held in the holding position.

According to the embodiment, when the valve body is held in the holding position in its stopped state, the gas pressure of the gas pressure spring is controlled. More specifically, in the state where the valve body is held in the holding position, the gas pressure is controlled such that the spring force of the spring for urging the valve body towards the non-holding end is reduced to be smaller than that of the gas pressure spring for urging the valve body towards the holding position. That is, the resultant force of the gas pressure springs in the holding position may be directed towards the holding position.

Such control of the gas pressure may be executed by reducing the gas pressure within the pressure chamber of the gas pressure spring for urging the valve body towards the non-holding end, increasing the gas pressure within the pressure chamber of the gas pressure spring for urging the valve body towards the holding end, or combination thereof.

The aforementioned structure makes it possible to hold the valve body in the holding position without requiring the electromagnetic force of the electromagnet. As a result, the energy required for holding the valve body in the holding position either the fully-opened position or the fully-closed position in the stopped state of the open and close operation of the electromagnetically driven valve.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF PREFERRED EMBODIMENTS

Hereinafter, a preferred embodiment of the invention will be described in detail with reference to the accompanying drawings. In the embodiment, the invention is applied to a control unit for opening and closing an electromagnetically driven valve serving as an intake valve or an exhaust valve of a multiple-cylinder internal combustion engine mounted on a vehicle.

In the embodiment, the intake and exhaust valves are both structured as electromagnetically driven valves that are driven to be opened and closed by electromagnetic force of electromagnets and spring force of springs. Since the intake and exhaust valves have substantially the same structures, the inside structure of the electromagnetically driven valve will be hereinafter described with respect to the intake valve.

Figure 1:
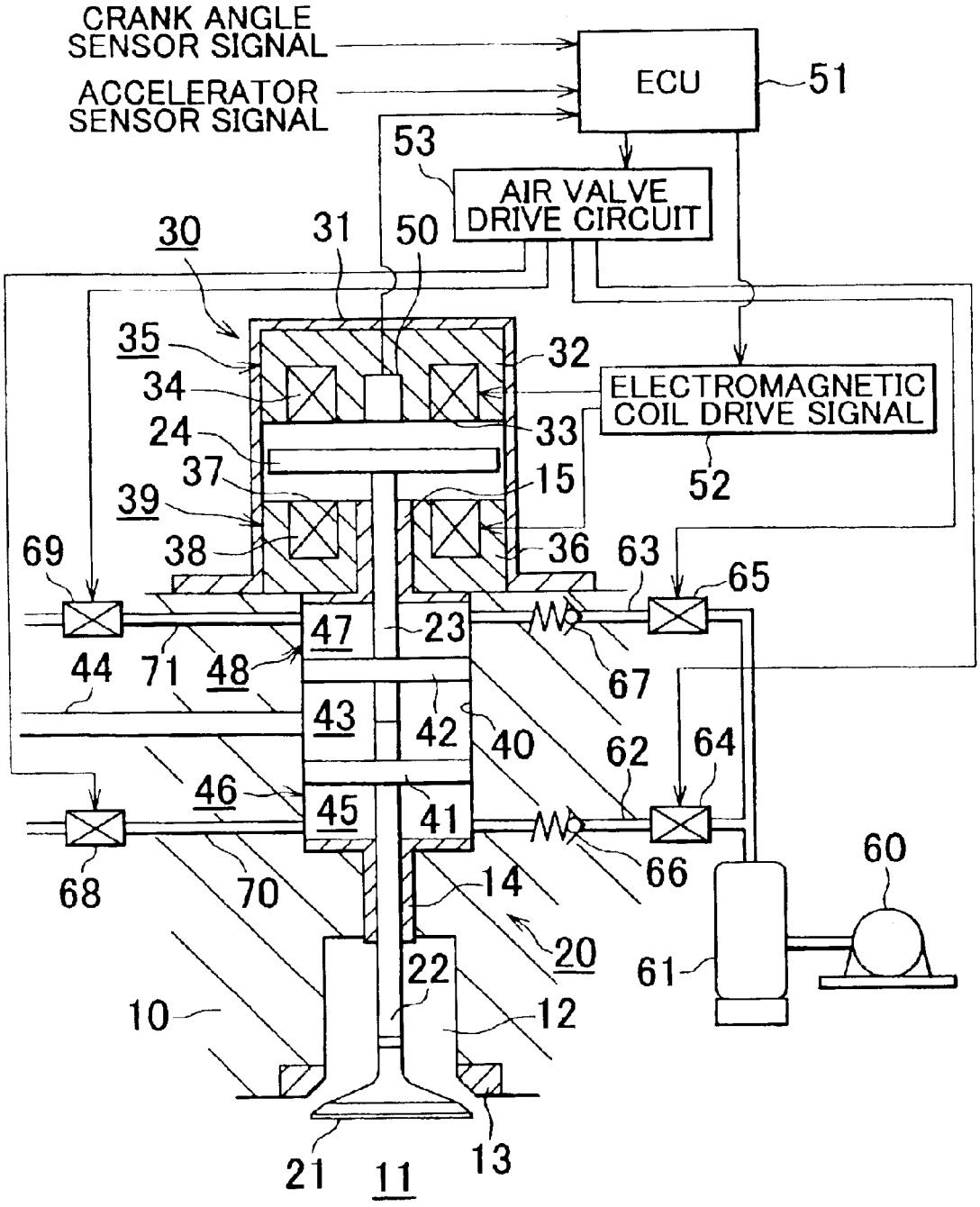
FIG. 1 is a block diagram that shows a structure of a control unit of an electromagnetically driven valve according to one preferred embodiment of the invention.

Referring to FIG. 1, a cylinder head 10 of an internal combustion engine has an intake port 12 that communicates with a combustion chamber 11, and an electromagnetically driven valve 20 for opening and closing the intake port 12.

The electromagnetically driven valve 20 includes a valve body 21 fixed at one end of a valve shaft 22, an electromagnetic drive portion 30 for generating electromagnetic force to drive the valve body 21 to be opened and closed, and a pair of air pressure springs 46, 48 for urging the valve body 21 towards opposite ends at the valve-opening side and the valve-closing side, respectively.

The valve body 21 is arranged in an opening of the intake port 12 so as to be exposed to the interior of the combustion chamber 11. A valve seat 13 is provided along the circumference of the opening of the intake port 12. The intake port 12 is closed when the valve body 21 rests or abuts upon the valve seat 13, whereas it is opened when the valve body 21 moves away from the valve seat 13. More specifically, referring to FIG. 1, the valve body 21 is displaced upward to rest or abut upon the valve seat 13 to close the intake port 12 with respect to the interior of the combustion chamber 11. Meanwhile, the valve body 21 is displaced downward away from the valve seat 13 to open the intake port 12 with respect to the interior of the combustion chamber 11.

The valve shaft 22 having the valve body 21 fixed to one end is supported by a valve guide 14 fixed to the cylinder head 10 such that the shaft 22 can axially reciprocate along the direction of the valve shaft 22. The upper end of the valve shaft 22 abuts on the lower end of an armature shaft 23. The armature shaft 23 is supported by an armature guide 15 fixed to the cylinder head 10 such that the armature shaft 23 is allowed to reciprocate coaxially with the valve shaft 22.

A disc-like armature 24 made of a high magnetic-permeability material is fixed at the upper end of the armature shaft 23. The upper portion of the armature shaft 23 to which the armature 24 is fixed is arranged within a casing 31 of the electromagnetic drive portion 30.

Within the casing 31, an upper core 32 made of a high magnetic-permeability material is fixedly positioned above the armature 24. An annular groove 33 is formed in one side of the upper core 32 facing the armature 24, and an electromagnetic coil 34 wound into an annular shape is received in the groove 33. Thus, the upper core 32 and the electromagnetic coil 34 constitute a valve-closing electromagnet 35 for driving the valve body 21 towards the valve-closing side.

Within the casing 31, also, a lower core 36 which is also made of a high magnetic-permeability material is fixedly positioned below the armature 24 so as to be spaced from the upper core 32 by a predetermined distance. As in the upper core 35, an annular groove 37 is formed in one side of the lower core 36 facing the armature 24, and an electromagnetic coil 38 wound into an annular shape is received in the groove 37. Thus, the lower core 36 and the electromagnetic coil 38 constitute a valve-opening electromagnet 39 for driving the valve body 21 towards the valve-opening side.

In addition, a displacement sensor 50 for detecting displacement amounts of the armature 24 is installed within the casing 31, and is operable to produce detection results which are used for determining the stroke position of the valve body 21.

In the cylinder head 10, a cylinder 40 having an annular internal space is formed between the valve guide 14 and the armature guide 15. A disc-like piston 41 is fixed to the upper portion of the valve shaft 22 while a disc-like piston 42 is fixed to the lower portion of the armature shaft 23. Within the cylinder 40, the pistons 41, 42 are arranged in abutment on the inner side wall of the cylinder 40 such that they can reciprocate in the axial direction of the valve shaft 22 and the armature shaft 23 by sliding along the inner side wall.

The interior of the cylinder 40 is divided into three spaces by the pistons 41, 42. Among those three spaces, a center space 43 defined by the pistons 41, 42 is open to the atmosphere via a communication passage 44.

A space 45 formed between the valve guide 14 provided in the lower end of the cylinder 40 and the piston 41 fixed to the upper portion of the valve shaft 22 serves as a pressure chamber into which compressed air is introduced. With this arrangement, the valve shaft 22 is urged towards the valve-closing side (upward direction in FIG. 1) via the piston 41 by the air pressure in the pressure chamber 45, more precisely, due to the difference between the air pressure in the pressure chamber 45 and that in the center space 43 which is namely the ambient pressure. Thus, the piston 41, the pressure chamber 45, and the lower portion of the cylinder 40 constitute a valve-closing air pressure spring 46 for urging the valve body 21 towards the valve-closing end.

Likewise, a space 47 formed between the armature guide 15 provided in the upper end of the cylinder 40 and the piston 42 fixed to the lower portion of the armature shaft 23 serves as a pressure chamber into which compressed air is introduced. With this arrangement, the armature shaft 23 is urged against the valve-opening side (downward direction in FIG. 1) via the piston 42 by the air pressure in the pressure chamber 47, more precisely, due to the difference between the air pressure in the pressure chamber 47 and that in the center space 43 which is namely the ambient pressure. Thus, the piston 42, the pressure chamber 47, and the upper portion of the cylinder 40 constitute a valve-opening air pressure spring 48 for urging the valve body 21 towards the valve-opening end.

With the valve-closing air pressure spring 46 and the valve-opening air pressure spring 48 structured as described above, the valve shaft 22 and the armature shaft 23, when urged by those springs 46, 68, are pressed against each other so that they can reciprocate in one unit.

Hereinafter, the configuration of an air pressure circuit for driving the air pressure springs 46, 48 will be described with reference to FIG. 1. In this air pressure circuit, an air pump 60 and a reservoir tank 61 are provided.

The air pump 60 is adapted to compress the air drawn from the outside and supply the compressed air to the reservoir tank 61. The reservoir tank 61 accumulates the compressed air supplied from the air pump 60 while maintaining the pressure thereof at a constant pressure by means of a regulator or the like (not shown).

The reservoir tank 61 is connected to the pressure chamber 45 of the valve-closing air pressure spring 46 via an air supply passage 62 and to the pressure chamber 47 of the valve-opening air pressure spring 48 via an air supply passages 63.

A control valve 64 (or 65) and a check valve 66 (or 67) are disposed in an intermediate portion of each of the air supply passages 62, 63 in consecutive order from the side of the reservoir tank 61. The control valves 64, 65 function as flow control valves for controlling the flow rate of the compressed air supplied from the reservoir tank 61 to the pressure chambers 45, 47 respectively.

The check valve 66 (or 67) is a normally closed differential pressure valve and is adapted to open to replenish the pressure chamber 45 (or 47) with compressed air when the air pressure in the pressure chamber 45 (or 47) becomes lower than the pressure in a portion of the air supply passage 62 (or 63) upstream of the check valve 66 (or 67).

Moreover, an exhaust passage 70 including a relief valve 68 disposed along an intermediate portion thereof is connected at one end to the pressure chamber 45 of the valve-closing air pressure spring 46 while an exhaust passage 71 including a relief valve 69 disposed along an intermediate portion thereof is connected at one end to the pressure chamber 47 of the valve-open air pressure spring 48. The other end of each exhaust passage 70 or 71 is open to the atmosphere.

The relief valve 68 (or 69) is a normal-close type pressure valve, and is adapted to open when the air pressure in the pressure chamber 45 (or 47) becomes equal to or higher than a predetermined pressure, so as to discharge excess compressed air from the pressure chamber 45 (or 47). Besides, the relief valve 68 (or 69) is forcibly opened upon receipt of an external command.

Thus, the amount of compressed air to be stored in the pressure chamber 45 of the valve-closing air pressure spring 46 and the pressure chamber 47 of the valve-opening air pressure spring 48 is adjusted through the air pressure circuit constructed as described above, so as to achieve desired spring force of each air pressure spring. In the meantime, during the normal open and close operation of the electromagnetically driven valve 20, a substantially equal amount of compressed air is stored in the pressure chambers 45, 47 so that the spring force of the valve-closing air pressure spring 46 and that of the valve-opening air pressure spring 48 are balanced with each other.

Though not shown in FIG. 1, the air passages 62, 63, the control valves 64, 65, the check valves 66, 67, the relief valves 68,69, and the exhaust passages 70, 71 are provided for each of the intake and exhaust valves of the internal combustion engine, and the air pressure in the valve-closing air pressure spring 46 and that in the valve-opening air pressure spring 48 are separately adjusted in each valve as aforementioned.

The structure and operation of a control unit for controlling the electromagnetically driven valve 20 will be described with reference to FIG. 1. An ECU (Electronic Control Unit) 51, arranged to perform various controls of the internal combustion engine, includes input and output ports. The ECU 51 receives through the input port detection signals indicative of various operating conditions of the internal combustion engine from sensors such as a crank angle sensor and an accelerator sensor (i.e., an accelerator angle or opening sensor), as well as detection signals from a displacement sensor 50. The output port of the ECU 51 is connected to an electromagnetic coil drive circuit 52 and an air valve drive circuit 53.

In accordance with the engine operating conditions determined based on the detection signals from the aforementioned sensors, the ECU 51 generates control signals for supplying current to the respective electromagnetic coils 34, 38 in the electromagnetically driven valve 20 and transmits the generated control signals to the electromagnetic drive circuit 52. The electromagnetic drive circuit 52 generates current for driving the electromagnetic coils 34, 38 by amplifying the control signals received from the ECU 51 and supplies the generated current to each coil.

Also, the ECU 51 controls, via the air valve drive circuit 53, the control valves 64, 65 and the relief valves 68, 69, to adjust the air pressure in the pressure chamber 45 of the valve-closing air pressure spring 46 and in the pressure chamber 47 of the valve-opening air pressure spring 48 on the basis of the determined engine operating conditions.

According to the electromagnetically driven valve 20 of the embodiment structured as described above, the valve body 21, to be displaced together with the valve shaft 22 and the armature shaft 23, reciprocates between one stroke end thereof in which the valve body 21 abuts or rests upon the valve seat 13 and the other stroke end in which the armature 24 abuts on the lower core 36.

When the valve body is in the stroke end where it abuts or rests upon the valve seat 13, namely in the valve closing end, the electromagnetically driven valve 20 is fully closed. This stroke position of the valve body 21 is therefore designated as "a fully-closed position."

Conversely, when the valve body 21 is in the other stroke end where the armature 24 abuts on the lower core 36, namely in the valve opening end, the electromagnetically driven valve 20 is fully opened. This stroke position of the valve body 21 is therefore designated as "a fully-opened position."

As described above, a substantially equal amount of compressed air is stored in the pressure chamber 45 of the valve-closing air pressure spring 46 and the pressure chamber 47 of the valve-opening air pressure spring 48 during the normal open and close operation of the electromagnetically driven valve 20. In this state, therefore, if no electromagnetic force is generated by the electromagnets 35, 39, the valve body 21 that is displaced together with the valve shaft 22 and the armature shaft 23 settles in a stroke position where the spring forces of the air pressure springs 46, 68 are balanced. At this time, namely, the valve body 21 settles in a stroke position where the pressure chambers 45, 47 have an equal internal capacity and generate an equal internal air pressure Pn so that the spring force Fcl of the valve-closing air pressure spring 46 and the spring force Fop of the valve-opening air pressure spring 48 are balanced.

Here, this stroke position of the valve body 21 in which the spring force Fcl of the valve-closing air pressure spring 46 and the spring force Fop of the valve-opening air pressure spring 48 are balanced is designated as "a neutral position." FIG. 1 shows the state where the valve body 21 of the electromagnetically driven valve 20 rests in the neutral position.

Figure 3:
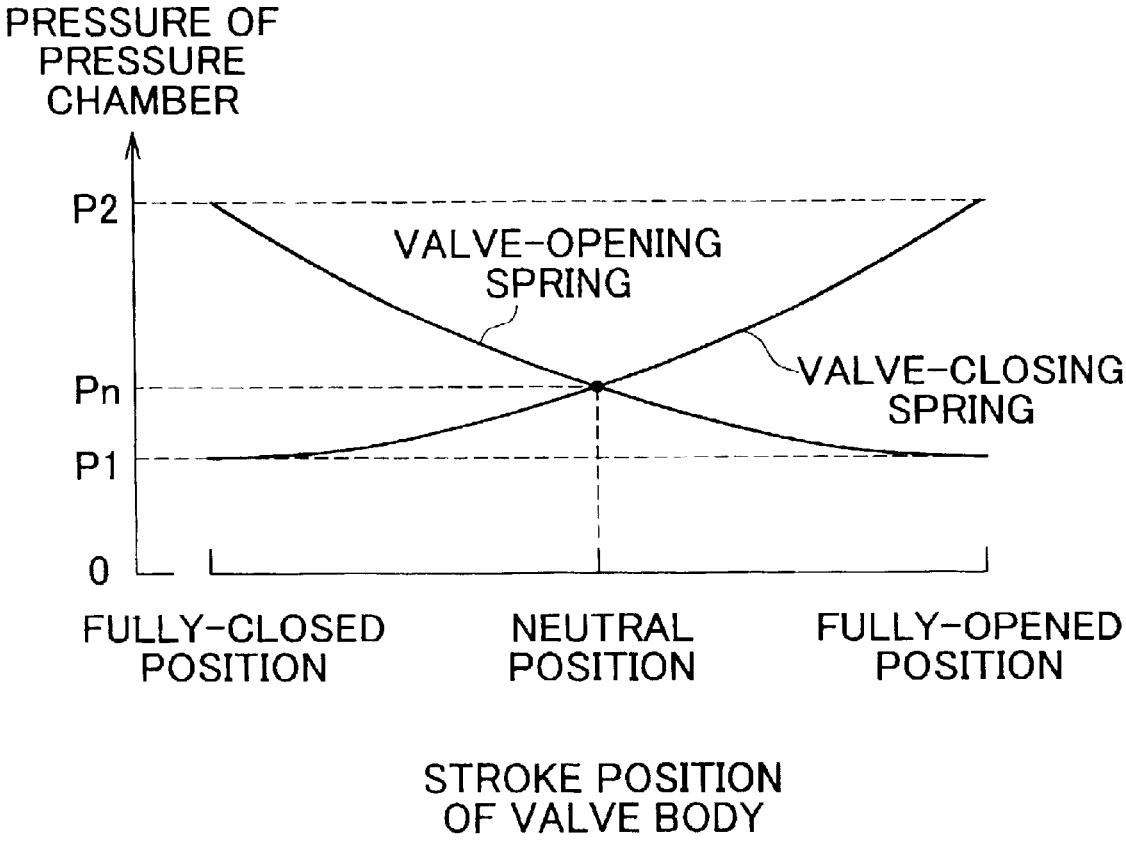
FIG. 3 is a graph showing the relationship between the stroke position of the valve body and the air pressure within a pressure chamber of an air pressure spring during open and close operation.

As the valve body 21 is displaced apart from the neutral position, the pistons 41, 42 are together displaced within the cylinder 40. At this time, the internal capacities of the pressure chambers 45, 47 of the air pressure springs 46, 48 change accordingly, as the air pressures therein change. The graph of FIG. 3 represents how the air pressures in the pressure chambers 45, 47 change with a shift in the stroke position of the valve body 21.

The internal capacity of the pressure chamber 45 of the valve-closing air pressure spring 46 becomes minimized when the valve body 21 is in the fully-opened position, and increases as the valve body 21 is displaced towards the fully-closed position. Thus, referring to FIG. 3, the air pressure in the pressure chamber 45 becomes a minimum pressure P1 when the valve body 21 is in the fully-closed position and increases as the valve body 21 is displaced towards the fully-opened position, and becomes a maximum pressure P2 when the valve body 21 reaches the fully-opened position.

Conversely, the internal capacity of the pressure chamber 47 of the valve-opening air pressure spring 48 becomes maximized when the valve body 21 is in the fully-opened position, and decreases as the valve body 21 is displaced towards the fully-closed position. Thus, referring to FIG. 3, the air pressure in the pressure chamber 47 becomes the minimum pressure P1 when the valve body 21 is in the fully-opened position and increases as the valve body 21 is displaced towards the fully-closed position, and becomes the maximum pressure P2 when the valve body 21 reaches the fully-closed position.

Figure 2A:
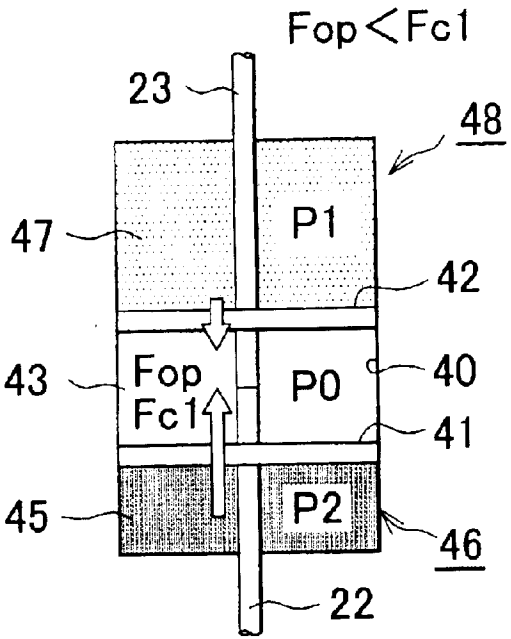
FIGS. 2A to 2C show each view of operating states of an air pressure spring of the electromagnetically driven valve in accordance with the embodiment.
Figure 2B:
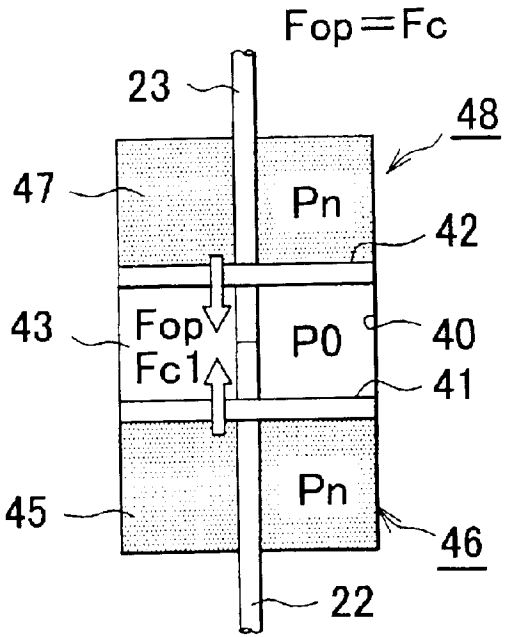
Figure 2C:
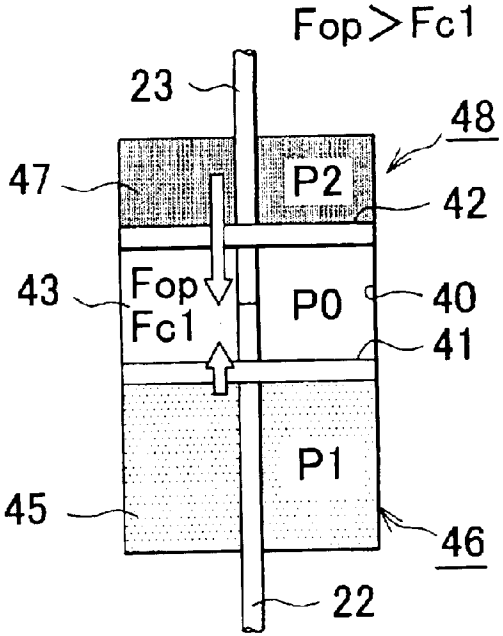

Accordingly, when the valve body 21 is held in the fully-opened position, as shown in FIG. 2A, the air pressure in the pressure chamber 45 of the valve-closing air pressure spring 46 becomes the maximum pressure P2 while the air pressure in the pressure chamber 47 of the valve-opening air pressure spring 48 becomes the minimum pressure P1. In this state, the valve body 21 is displaced towards the valve-closing end by the resultant force of the air pressure springs 46, 48 (Fcl>Fop). On the other hand, when the valve body 21 is held in the fully-closed position, as shown in FIG. 2C, the air pressure in the pressure chamber 47 of the valve-open air pressure spring 48 becomes the maximum pressure P2 while the air pressure in the pressure chamber 45 of the valve-open air pressure spring 46 becomes the minimum pressure P1. In this state, the valve body 21 is displaced towards the valve-opening end by the resultant force of the air pressure springs 46, 48 (Fop>Fcl).

In the meantime, the minimum pressure P1 obtained when the internal capacity of each pressure chamber 45 or 47 becomes maximum is set to a pressure sufficiently higher than the atmospheric pressure P0.

Hereinafter, the normal open and close operation of the electromagnetically driven valve 20 will be described. When the valve body 21 is in the fully-closed position, as described above, the valve body 21 is urged towards the valve-opening end by the resultant force of the air pressure springs 46, 48. At this time, therefore, the electromagnetic coil 34 of the valve-closing electromagnet 35 is energized to hold the valve body in the fully-closed position. More specifically, the holding current is supplied to the electromagnetic coil 34 to generate electromagnetic force and the armature 24 is kept attached to the upper core 32 by the generated electromagnetic force while holding the valve body 21 in the fully-closed position. Here, the level of the holding current supplied to the electromagnetic coil 34 is set such that the armature 24 can be kept attached to the upper core 32 against the resultant force of the air pressure springs 46, 48.

Next, when the valve body 21 held in the fully-closed position is driven to the fully-opened position, the holding current supplied to the electromagnetic coil 34 is cut off. Accordingly the armature 24 is detached from the upper core 32 such that the valve body 21 is displaced away from the fully-closed position towards the valve-opening end by the resultant force of the air pressure springs 46, 48 acting on the same side.

Subsequently, the magnitude of the resultant force of the air pressure springs 46, 48 for urging the valve body towards the valve-opening end reduces as the valve body 21 becomes closer to the fully-opened position. When the valve body 21 is displaced closer to the fully-opened end than the neutral position, the resultant force begins to act in the opposite direction to displace the valve body 21 towards the valve-closing end. In the aforementioned state, however, due to the inertial force acting on the valve body 21, the valve body 21 continues to displace towards the valve-opening end against the resultant spring force.

Then, when the valve body 21 has reached a predetermined stroke position, current (hereinafter referred to as "attracting current" where appropriate) is supplied to the electromagnetic coil 38 of the valve-opening electromagnet 39. More specifically, the attracting current supplied to the electromagnetic coil 38 may generate electromagnetic force so as to cause the armature 24 to be attracted towards the lower core 36. Thus, due to the inertial force acting on the valve body 21 and the electromagnetic force generated by the valve-opening electromagnet 39, the valve body 21 continues to displace towards the valve-opening end against the resultant force of the air pressure springs 46, 48. Here, the level of the attracting current is set such that the armature 24 can be securely attached to the lower core 36 in accordance with, for example, the stroke position of the valve body 21 detected by the displacement sensor 50.

When the armature 24 has been attached to the lower core 36, namely, when the valve body 21 has reached the fully-closed position, the holding current is then supplied to the electromagnetic coil 38 of the valve-opening electromagnet 39 to generate electromagnetic force, and the armature 24 is then attracted and attached to the lower core 36 by the generated electromagnetic force.

Also, the valve body 21 held in the fully-opened position is driven to the fully-closed position by energizing or de-energizing the electromagnets 35, 39 in a similar way taken when driving the valve body 21 from the fully-closed position to the fully-opened position. That is, supply of the holding current of the electromagnetic coil 38 of the valve-opening electromagnet 39 is stopped to start displacement of the valve body 21 towards the valve-closing end such that the attracting current is supplied to the electromagnetic coil 34 of the valve-closing electromagnet 35. As a result, the armature 24 is kept attached to the upper core 32.

After the valve body 21 has reached the fully-closed position, the electromagnets 35, 38 are repeatedly energized and de-energized, thus continuing the open and close operation of the electromagnetically driven valve 20.

The internal combustion engine in the embodiment is arranged to stop combustion in at least one of the cylinders when it is running under a low load. In this case, the open and close operation of the electromagnetically driven valve 20 serving as the intake or exhaust valve in the cylinder in which combustion has been stopped is interrupted so as to reduce the number of the electromagnetically driven valves 20 to be operated for opening and closing. In a stopped state of the open and close operation of the electromagnetically driven valve 20 as described above, the valve body 21 of the electromagnetically driven valve 20 is held in the fully-closed position.

In the state where the valve body 21 is normally operated for opening and closing while being held in the fully-closed position, the valve body 21 is urged towards the valve-opening end by the resultant force of the air pressure springs 46, 48. In order to hold the valve body 21 in the fully-closed position, it is therefore necessary to continue supply of the holding current to the electromagnetic coil 34 of the valve-closing electromagnet 35.

In the embodiment, however, the valve body 21 of the electromagnetically driven valve 20 can be held in the fully-closed position in the stopped state of the open and close operation by controlling the air pressure as described below without requiring supply of the holding current. As a result, the energy required for holding the valve body 21 in the fully-closed position may be reduced.

Figure 4:
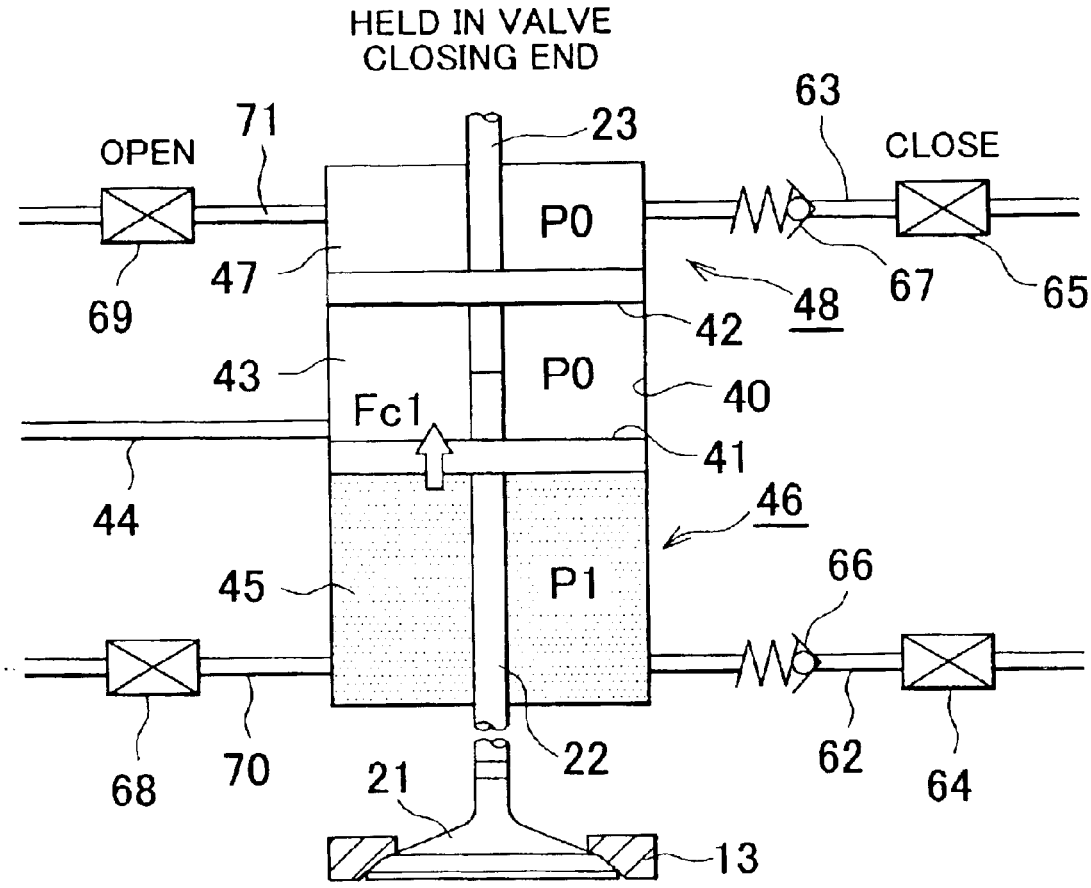
FIG. 4 is a view that shows an operation state of the electromagnetically driven valve when the valve body is held in the fully closed position.

In the embodiment, when the open and close operation of the electromagnetically driven valve 20 is interrupted, the control valve 65 of the air supply passage 63 connected to the pressure chamber 47 of the valve-opening air pressure spring 48 is closed to cut off supply of compressed air to the pressure chamber 47. Meanwhile, the relief valve 69 of the exhaust passage 71 connected to the pressure chamber 47 is forcibly opened so as to be communicated with atmosphere as shown in FIG. 4 such that the compressed air stored in the pressure chamber 47 is discharged.

As the air pressure within the pressure chamber 47 is reduced to the atmospheric pressure P0, no spring force is generated by the valve-closing air pressure spring 48. That is, the spring force Fop generated by the valve-opening air pressure spring 48 becomes 0. The spring force Fcl of the valve-closing air pressure spring 46 acts only on the valve body to be urged towards the valve closing end. Such spring force Fcl serves to hold the valve body 21 in the fully-closed position spontaneously.

In the embodiment, accordingly, the valve body 21 can be held in the fully-closed position when the open and close operation of the electromagnetically driven valve 20 is stopped without supplying the holding current to the electromagnetic coil 34 of the valve-closing electromagnet 35.

When resuming the open and close operation of the electromagnetically driven valve 20 having the valve body 21 held in the fully-closed position, compressed air is reintroduced into the pressure chamber 47 by canceling the forcible closing operation of the relief valve 69 so as to bring the electromagnetically driven valve into the normal operating state, and opening the control valve 65.

In the embodiment, when the valve body 21 is to be held in the fully-closed position for a long time, the air pressure of the valve-opening air pressure spring 48 for urging the valve body 21 towards the valve-opening end is made lower than the air pressure of the spring 48 during the normal open and close operation of the electromagnetically driven valve 20. In the state where the valve body 21 is held in the fully-closed position, the spring force Fop of the valve-opening air pressure spring 48 for urging the valve body 21 towards the fully-opened position is made smaller than the spring force Fcl of the valve-closing air pressure spring 46 for urging the valve body 21 towards the fully-closed position.

According to the exemplary embodiment, the following effects and advantages are obtained.

(1) In the embodiment, the air pressure of the valve-opening air pressure spring for urging the valve body 21 towards the valve opening end is decreased to be lower than the air pressure of the spring 48 during normal open and close operation of the electromagnetically driven valve 20 such that the valve body 21 is held in the fully-closed position when the open and close operation of the electromagnetically driven valve 20 is stopped. As a result, the force that urges the valve body 21 towards the valve opening end is reduced. In the embodiment, the air pressure of the valve opening air pressure spring 48 is reduced when the valve body 21 is held in the fully-closed position and the spring force Fop of the valve opening air pressure spring 48 is set to zero such that the spring force Fop becomes smaller than the spring force Fcl of the valve-closing air pressure spring 46. Accordingly, the resultant force of the air pressure springs 46, 48 acts in the direction for urging the valve body 21 towards the valve closing end. This makes it possible to hold the valve body 21 spontaneously in the fully-closed position without supplying the holding current to the valve-closing electromagnet 35. The energy required for holding the valve body 21 in the fully-closed position can be reduced, thus reducing power consumption.

(2) In the state where the valve body 21 is held in the fully closed position, the air pressure of the valve-opening air pressure spring 48 is reduced by forcibly opening the relief valve 69 so as to make the pressure chamber 47 open to the atmosphere. This makes it possible to reduce the air pressure of the valve-opening air pressure spring quickly and reliably.

Meanwhile, the valve body 21 can be held in the fully-opened position in the manner as described above when the open and close operation of the electromagnetically driven valve 20 is stopped. In this case, the power required for holding the valve body 21 can be reduced, thus leading to a further reduction in power consumption of the control unit of the electromagnetically driven valve.

Figure 5:
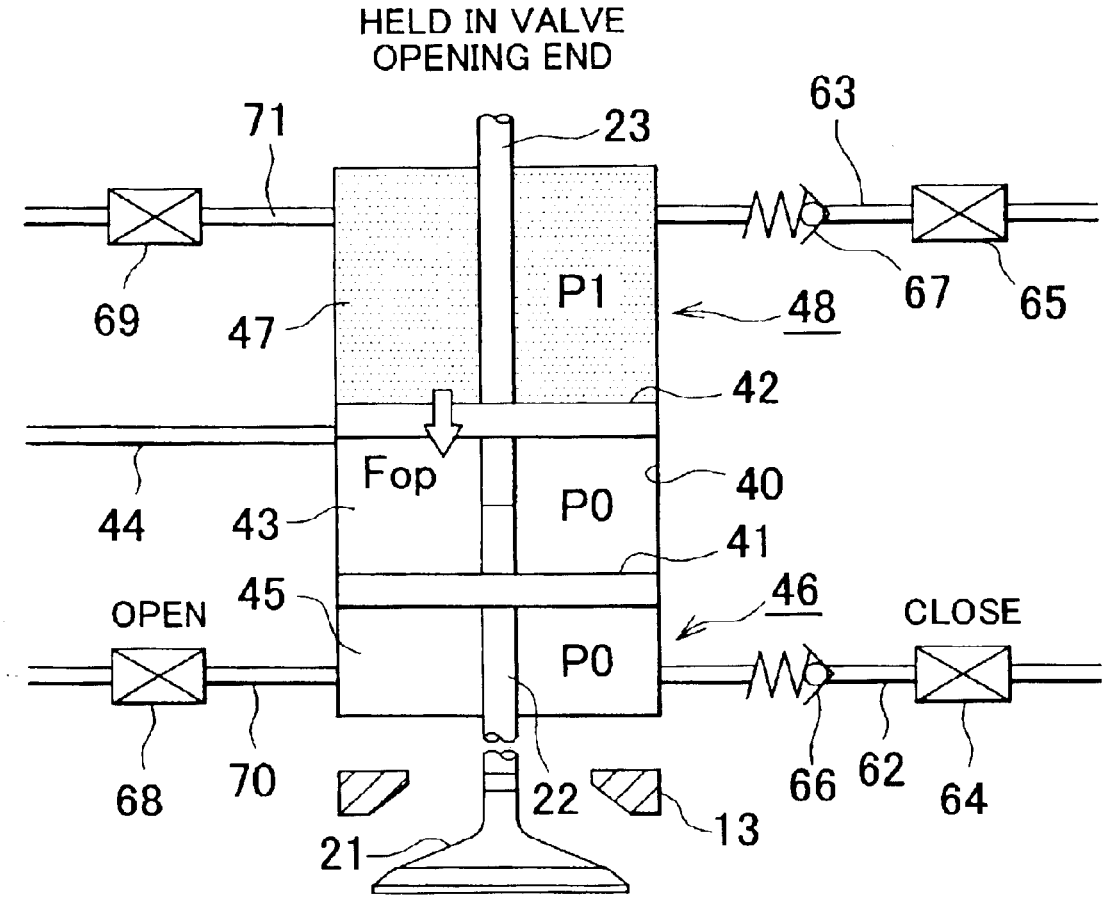
FIG. 5 is a view that shows an operation state of the electromagnetically driven valve when the valve body is held in the fully-opened position.

In the aforementioned case, referring to FIG. 5, the control valve 64 of the air supply passage 62 connected to the pressure chamber 45 of the valve-closing air pressure spring 46 may be closed, and the relief valve 68 of the exhaust passage 70 connected to the pressure chamber 45 is forcibly opened. This makes it possible to reduce the air pressure within the pressure chamber 45 of the valve-closing air pressure spring 46 for urging the valve body towards the valve closing position to the atmospheric pressure P0. Like the aforementioned case in which the valve body 21 is held in the fully closed position, the power consumption for holding the valve body in the full valve closing position.

Hereinafter, modified examples of the embodiment will be described. In the embodiment, when the open and close operation of the electromagnetically driven valve 20 is stopped, the valve body 21 is held in the fully-closed (fully-opened) position by forcibly opening the relief valve 69 (68) to make the pressure chamber 48 (45) open to the atmosphere. As a result, the air pressure of the valve-opening air pressure spring 48 (the valve-closing air pressure spring 46) is reduced. The air pressure of the air spring may be reduced by any other way so long as the air pressure of the spring 48 (46) can be sufficiently reduced at a time when the valve body 21 is held in the fully-closed (fully-opened) position in the stopped state of the electromagnetically driven valve 20. Accordingly, the energy for holding the valve body of the electromagnetically driven valve 20, thus reducing the power consumption.

In the embodiment, the air pressure of the valve opening air pressure spring 48 (or valve-closing air pressure spring 46) is reduced to reach the atmospheric pressure P0 in the state where the valve body 21 is held in the fully-closed (fully-opened) position during stop of the open-close operation. The air pressure does not have to be reduced to the atmospheric pressure P0 so long as the power consumption can be sufficiently reduced. When the air pressure of the air pressure spring 48 or 46 for urging the valve body towards the valve-closing end or the valve-opening end is reduced to be lower than the air pressure spring 48 or 46 during the open-close operation of the electromagnetically driven valve, the urging force serving to move the valve body 21 away from the valve-closing end or the valve-opening end can be reduced. As a result, the magnitude of the electromagnetic force of the electromagnet 35 or 39 for holding the valve body 21 in the fully-closed position or the fully-opened position can be sufficiently decreased so as to reduce the holding current.

Further, when the air pressure in the valve-opening air pressure spring 48 (or 46) is reduced such that the resultant spring force of the air pressure springs 46, 48 at the fully-closed position (or the fully-opened position) acts towards the end of the corresponding displacement where the valve body 21 is held, the valve body 21 can be held without supplying the holding current to the electromagnet 35 (or 39). In the case where the valve body 21 is held in the fully-closed position as shown in FIG. 4, the resultant force of the air pressure springs 46, 48 serves to act towards the valve-closing side by reducing the air pressure of the valve-opening air pressure spring 48 to be lower than the air pressure P1 of the valve-closing air pressure spring 46. That is, the spring force Fop of the valve-opening air pressure spring 48 can be made smaller than the spring force Fcl of the valve-closing air pressure spring 46.

In the illustrated embodiment, the open-close operation of the intake or the exhaust valve of the cylinder where combustion has been stopped is halted and the valve body is held in the fully-closed or the fully-opened position by performing the air-pressure control. The air-pressure control may be effectively applied so long as the open-close operation of the valve body is stopped so as to be held in the fully-closed or the fully-opened position. The aforementioned air-pressure control may be applied to the internal combustion engine at the low load operation in which open-close operation of at least one of the intake valve of the respective cylinders is stopped so as to be held in the fully closed position. This may also allow reduction of power consumption.

The valve body 21 of the electromagnetically driven valve 20 may be held in the fully-closed or fully-opened position by the aforementioned air-pressure control while the internal combustion engine is in a stopped state. Generally, performing an initial operation to displace the valve body 21 to the fully-closed or the fully-opened position is required to start the open and close operation of the electromagnetically driven valve 20. If the valve body 21 is held in the fully-closed or the fully-opened position in the stopped state of the internal combustion engine, the initial operation of the valve body 21 does not have to be performed.

The configuration of the air pressure circuit, the arrangement of the air pressure springs 46, 48, the structure of the control system, and the like, are not limited to those in the illustrated embodiment, but may be modified where necessary. The aforementioned air pressure control can be applied to the electromagnetically driven valve that opens and closes by the electromagnetic force of the electromagnet and the spring force of the spring so long as the spring is formed of a pair of gas pressure springs for urging the valve body towards the valve opening end and the valve-closing end using the gas pressure within the pressure chamber. The aforementioned air pressure control makes it possible to save power for driving the electromagnetically driven valve.

In the embodiment, the air pressure spring is employed to generate a spring force caused by a pressure of air filled and compressed in the pressure chamber as the pair of springs for urging the valve body 21 towards the valve-opening end and the valve-closing end, respectively. However, any type of gas other than air may be used to generate the spring force. Control of gas pressure of the gas pressure spring makes it possible to obtain substantially the same advantageous effects as those obtained by control of air pressure of the air pressure spring.

Furthermore, the invention may also be applied as a control unit for controlling the electromagnetically driven valve that serves as being other than the intake or the exhaust valves of an internal combustion engine.

In an embodiment of the invention, the controller, when the operation of the valve body is stopped and held in the holding position, decreases an amount of gas filled in a pressure chamber of the one of the pair of gas springs that urges the valve body towards the non-holding position such that the amount of gas becomes smaller than an amount of gas of the pressure chamber of the gas pressure spring that urges the valve body towards the non-holding position when the valve body is operated.

In the embodiment, the controller controls an amount of gas filled in a pressure chamber of one of the pair of gas pressure springs when the valve body is held in the holding position such that a spring force of the one of the pair of gas pressure springs that urges the valve body towards the non-holding position becomes smaller than a spring force of the other gas pressure spring that urges the valve body towards the holding position.

In the embodiment, the valve body functions as an intake valve or exhaust valve of an internal combustion engine.

What is claimed is:

1. A control unit of an electromagnetically driven valve including a valve body, an electromagnetic drive portion and a spring, the valve body of the electromagnetically driven valve being opened and closed by an electromagnetic force of the electromagnetic drive portion and a spring force of the spring that is formed of a pair of gas pressure springs each urging the valve body towards a valve opening end position and a valve closing end position, respectively, the control unit comprising a controller, when an operation of the valve body is stopped and held in a holding position that is one of the valve opening end position and the valve closing end position, decreases a gas pressure of one of the pair of gas pressure springs that urges the valve body towards a non-holding position opposite to the holding position so as to become lower than a gas pressure of the one of the pair of gas pressure springs that urges the valve body towards the non-holding position when the valve body is operated, wherein the controller, when the operation of the valve body is stopped and held in the holding position, decreases an amount of gas filled in a pressure chamber of the one of the pair of gas springs that urges the valve body towards the non-holding position such that the amount of gas becomes smaller than an amount of gas filled in the pressure chamber of the gas pressure spring that urges the valve body towards the non-holding position when the valve body is operated.

2. A control unit according to claim 1, wherein the electromagnetically driven valve comprises one of an intake valve and an exhaust valve of an internal combustion engine.

3. A control unit of an electromagnetically driven valve including a valve body, an electromagnetic drive portion and a spring, the valve body of the electromagnetically driven valve being opened and closed by an electromagnetic force of the electromagnetic drive portion and a spring force of the spring that is formed of a pair of gas pressure springs each urging the valve body towards a valve opening end position and a valve closing end position, respectively, the control unit comprising a controller, when an operation of the valve body is stopped and held in a holding position that is one of the valve opening end position and the valve closing end position, decreases a gas pressure of one of the pair of gas pressure springs that urges the valve body towards a non-holding position opposite to the holding position so as to become lower than a gas pressure of the one of the pair of gas pressure springs that urges the valve body towards the non-holding position when the valve body is operated, wherein the controller controls an amount of gas filled in a pressure chamber of one of the pair of gas pressure springs when the valve body is held in the holding position such that a spring force of the one of the pair of gas pressure springs that urges the valve body towards the non-holding position becomes smaller than a spring force of the other gas pressure spring that urges the valve body towards the holding position.

4. A control unit according to claim 3, further comprising at least one control valve and at least one relief valve connected to the pressure chamber of the gas pressure spring that urges the valve body towards the non-holding position and operated to reduce a gas pressure thereof so as to be lower than a gas pressure of the pressure chamber of the other gas pressure spring that urges the valve body towards the holding position.

5. A control unit according to claim 3, wherein the electromagnetically driven valve comprises one of an intake valve and an exhaust valve of an internal combustion engine.

6. A method of controlling an electromagnetically driven valve including a valve body, an electromagnetic drive portion and a spring, the valve body of the electromagnetically driven valve being opened and closed by an electromagnetic force of the electromagnetic drive portion and a spring force of the spring that is formed of a pair of gas pressure springs each urging the valve body towards a valve opening end position and a valve closing end position, respectively, the method comprising, when an operation of the valve body is stopped and held in a holding position that is one of the valve opening end and the valve closing end, decreasing a gas pressure of one of the pair of gas pressure spring that urges the valve body towards a non-holding position opposite to the holding position to be lower than a gas pressure of the one of the pair of air springs that urges the valve body towards the non-holding position when the valve body is operated, wherein an amount of gas filled in a pressure chamber of the one of the pair of gas springs that urges the valve body towards the non-holding position is decreased such that the amount of gas becomes smaller than an amount of gas of the pressure chamber of the gas pressure spring that urges the valve body towards the non-holding position when the valve body is operated.

7. A method of controlling an electromagnetically driven valve including a valve body, an electromagnetic drive portion and a spring, the valve body of the electromagnetically driven valve being opened and closed by an electromagnetic force of the electromagnetic drive portion and a spring force of the spring that is formed of a pair of gas pressure springs each urging the valve body towards a valve opening end position and a valve closing end position, respectively, the method comprising, when an operation of the valve body is stopped and held in a holding position that is one of the valve opening end and the valve closing end, decreasing a gas pressure of one of the pair of gas pressure springs that urges the valve body towards a non-holding position opposite to the holding position to be lower than a gas pressure of the one of the pair of air springs that urges the valve body towards the non-holding position when the valve body is operated, wherein an amount of gas filled in a pressure chamber of one of the pair of gas pressure springs is controlled when the valve body is held in the holding position such that a spring force of the one of the pair of gas pressure springs that urges the valve body towards the non-holding position becomes smaller than a spring force of the other gas pressure spring that urges the valve body towards the holding position when the operation of the valve body is stopped and held in the holding position.

8. A method of controlling an electromagnetically driven valve according to claim 7, wherein at least one control valve and at least one relief valve connected to the pressure chamber of the gas pressure spring that urges the valve body towards the non-holding position are operated to reduce a gas pressure thereof so as to be lower than a gas pressure of the pressure chamber of the other gas pressure spring that urges the valve body towards the holding position.

* * * * *